United States Patent [19]

Lundberg

[11] Patent Number: 4,479,450

[45] Date of Patent: Oct. 30, 1984

[54] FLOATING DOCK

[75] Inventor: Thorsten Lundberg, Gothenburg, Sweden

[73] Assignee: Gotaverken Arendal AB, Sweden

[21] Appl. No.: 528,662

[22] Filed: Sep. 1, 1983

Related U.S. Application Data

[63] Continuation of Ser. No. 309,474, Oct. 7, 1981, abandoned.

[30] Foreign Application Priority Data

Oct. 13, 1980 [SE] Sweden ..... 8007162

[51] Int. Cl.[3] ..... B63C 1/06

[52] U.S. Cl. ..... 114/46; 114/77 A; 114/125; 114/49; 405/4

[58] Field of Search ..... 114/77 R, 77 A, 45–48, 114/51, 266, 267, 121, 125, 263; 405/218, 219, 221, 4–7

[56] References Cited

U.S. PATENT DOCUMENTS

| | | | |
|---|---|---|---|
| 710,765 | 10/1902 | Cunningham | 114/46 |
| 2,291,078 | 7/1942 | Harris | 114/46 |
| 2,431,039 | 11/1947 | Harrison | 114/77 R |
| 2,465,851 | 3/1949 | Crandall | 114/46 |
| 2,728,319 | 12/1955 | Engstrand | 114/77 R |
| 2,732,818 | 1/1956 | Quirin | 114/77 R |
| 2,774,322 | 12/1956 | Harris | 114/46 |
| 2,894,472 | 7/1959 | Foster | 114/125 |
| 3,421,469 | 1/1969 | Yamada et al. | 114/77 R |
| 3,587,503 | 6/1971 | Stehr | 114/266 |
| 3,614,938 | 10/1971 | Statile | 114/77 R |
| 3,735,722 | 5/1973 | Hooper et al. | 114/77 R |
| 3,788,254 | 1/1974 | Sheil | 114/266 |
| 3,965,513 | 6/1976 | Horiuchi | 114/77 R |
| 4,267,788 | 5/1981 | Blanco | 114/125 |
| 4,314,519 | 2/1982 | Yunoki et al. | 114/125 |

FOREIGN PATENT DOCUMENTS 280212 12/1913 Fed. Rep. of Germany .

*Primary Examiner*—Trygve M. Blix
*Assistant Examiner*—Stephen P. Avila
*Attorney, Agent, or Firm*—Cantor and Lessler

[57] ABSTRACT

In order to make possible a "self-docking" of a floating dock, the dock is divided into a middle pontoon and two end pontoons, which are interconnectable in alternative positions in the vertical direction, so either the middle pontoon, or the end pontoons may be lifted out of the water. The pontoons are held together by bolts, which are accessible from cofferdam-like spaces, formed when two pontoons are fitted together, and which may be maintained watertight. Male and female coupling members are furthermore provided to secure the pontoons in their two operative positions. During a disconnecting and connecting operation the pontoons are guided by rigid link arms, chains or the like.

7 Claims, 12 Drawing Figures

FLOATING DOCK

This application is a continuation of application Ser. No. 309,474, filed Oct. 7, 1981, now abandoned.

BACKGROUND OF THE INVENTION

The overhaul and repair of big floating docks raises many problems, as there seldom is any possibility to drydock the dock itself. It has been proposed to build a floating dock in sections, where each section may be disengaged from the remainder of the dock and be docked therein. The sections are interconnected by bolts, but as they are located in spaces which are used as ballast tanks they will soon be cemented by rust and must be cut apart. A disengaging of a pontoon is therefore a difficult operation, which is often put off too long.

The aim of the present invention is to propose a self docking dock, where the interconnection between the various portions is arranged so the mounting and dismounting operations are considerably reduced, and where it is possible, in two operations, to lift the whole underwater body of the dock out of the water, for cleaning, painting and possible repair.

SUMMARY OF THE INVENTION

A dock according to the invention comprises a middle pontoon and two end pontoons, which all are provided with individually operable ballast tanks, and are removably attachable to each other, the end pontoons being dimensioned to lift the middle pontoon fully out of the water, and the latter being so dimensioned that it can lift the end pontoons fully out of the water. The characterizing feature is that the end faces of the pontoons are advantageously provided with male and female coupling members, which are located vertically so as to permit an interengagement of juxtaposed faces of the pontoons in different height positions.

Guiding means interconnecting juxtaposed end faces of adjacent pontoons are preferably provided and adapted to permit a vertical displacement of the pontoons between two different height positions. The guiding means may comprise rigid link arms, in which case ballast tanks within the end pontoons preferably are arranged to permit a trimming of the pontoons transversely. Alternatively the guiding means may comprise chains or similar nonrigid members, in which case the ballast tanks within the end pontoons are arranged so as to permit a trimming of the end pontoons longitudinally as well as transversely.

Means for interconnecting the pontoons are preferably located in open spaces at the end faces of the pontoons, these spaces being adapted together to form a watertight cofferdam within which the connecting means are accessible. Means for communication between the pontoons are preferably arranged in conjunction to the cofferdams and include pliable portions making the communication means unaffected by vertical displacement between the pontoons.

The cofferdams within the side walls preferably extend from the top to the bottom thereof, while the bottom portions of the pontoons lack interconnecting means.

The male and female coupling members at the end pontoons are advantageously located so as to permit an interconnection of the two end pontoons to each other.

DESCRIPTION OF A PREFERRED EMBODIMENT

Figure 1:
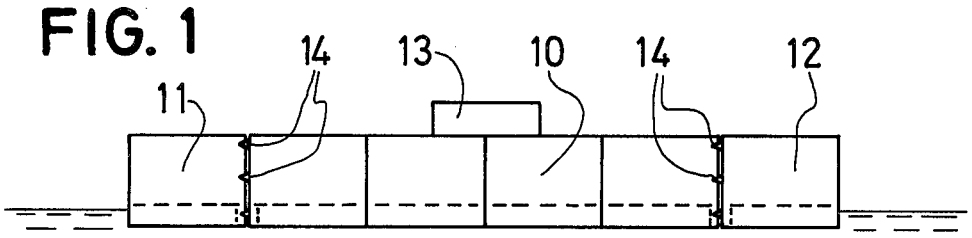
FIG. 1 schematically shows a floating dock according to the invention.

The floating dock shown in FIG. 1 comprises a middle pontoon 10 and two end pontoons 11 and 12, which are interconnected in a manner described herebelow. The middle pontoon 10 may be built in sections, and is provided with a control building 13, comprising means for governing the ballast arrangement, depth, trim and deflection indicators, as well as other conventional control devices.

Figure 2:
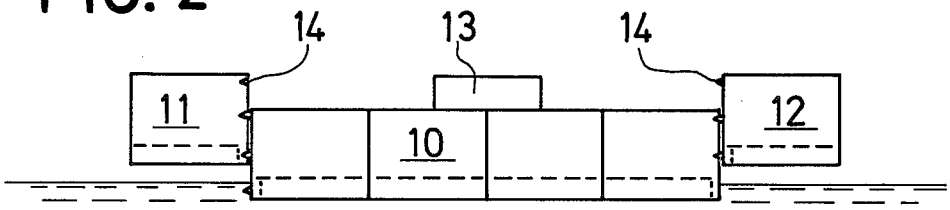
FIG. 2 shows the dock during maintenance operations at the end pontoons.
Figure 3:
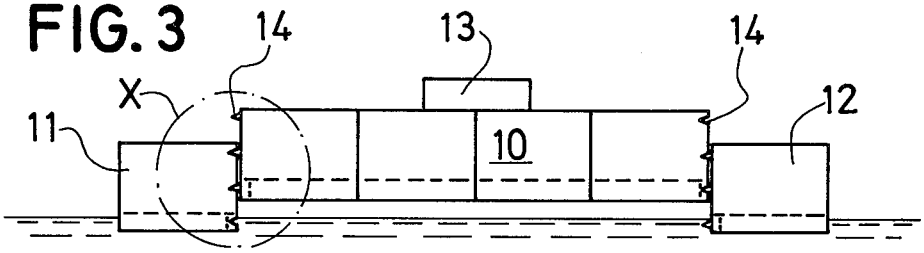
FIG. 3 shows the dock during maintenance operations at the middle pontoon.

An important feature of the invention is, that the middle pontoon 10 has sufficient capacity to lift the end pontoons 11 and 12 fully out of the water, as shown in FIG. 2. The end pontoons 11 and 12 are designed so they, together can lift the middle pontoon 10 fully out of the water, as is shown in FIG. 3.

It is evident that the under-water body of the dock in this manner may be made fully accessible in two operations. To facilitate the interconnection of the pontoons in different height positions, the end faces of the pontoons are provided with male and female coupling members 14, which locate the pontoons in proper positions in relation to each other.

During maintenance operations, for instance at the end pontoons (FIG. 2), all ballast tanks are emptied so the dock occupies a "light" position, whereupon the interconnecting means are removed. The middle pontoon is then lowered in the usual way by means of its ballast tanks, and is connected to the end pontoons in the alternative position determined by the male and female coupling members 14. Thereafter the ballast tanks of the middle pontoon are emptied so the end pontoons are lifted out of the water.

Figure 4:
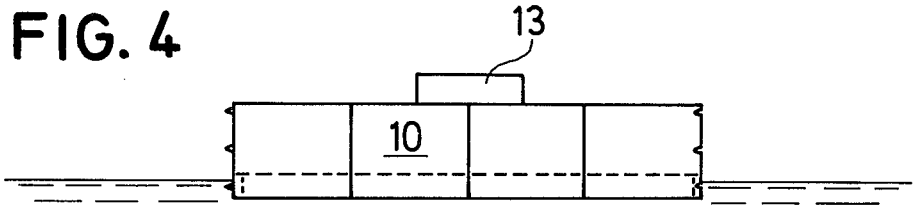
FIGS. 4 and 5 show the middle pontoon separated from the end pontoons, and the end pontoons connected to each other, respectively, FIG. 6 schematically shows an end view of a pontoon.
Figure 5:
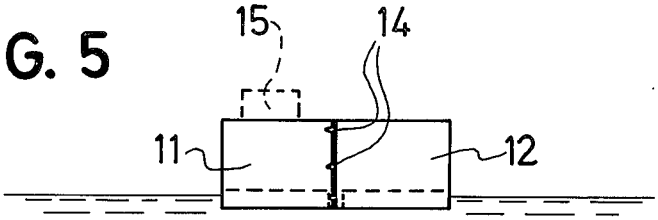

A further advantage of the simple interconnection means is that it is possible, on occasions when it is desirable to dock a number of units which do not require the full lifting capacity of the dock, to separate the pontoons, and use the middle pontoon 10 for docking small ships (FIG. 4), and the two end pontoons 11 and 12 for docking barges, oil drilling rigs and the like (FIG. 5).

The male and female members 14 are—as illustrated in FIG. 5—designed to permit a direct interconnection of the two end pontoons. One of those will then have to be provided with a control building 15, as is indicated by broken lines.

Figure 6:
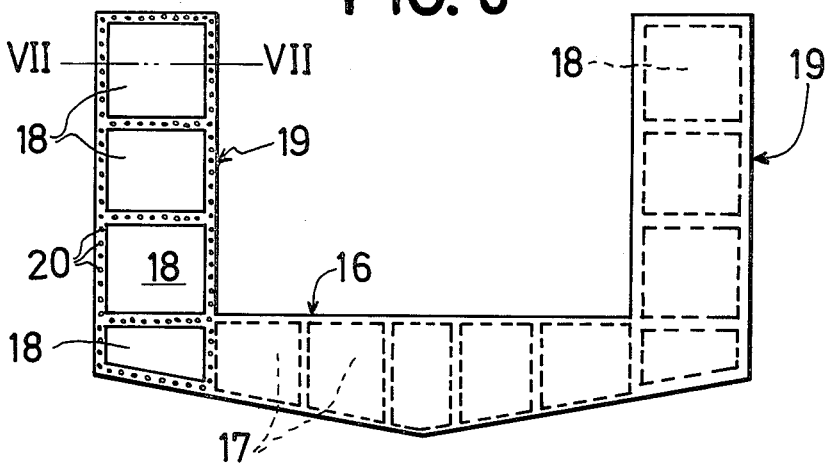

FIG. 6 shows an end view of a pontoon. Beams 20 for the attachment of bolts 21 (vide also FIG. 7) are provided adjacent to spaces within juxtaposed end faces of the side walls 19. The pontoons are not interconnected at their bottom portions 16.

At each end face of a side wall there is a channel-formed space 22, which is open towards the juxtaposed side wall. At the edges of this space, as well as at tween-decks 23, flanges 24 for the bolts 21 are provided. Rubber gaskets 25, or other sealing means are fitted between the flanges so the spaces 22, together, will form a watertight cofferdam 26, which is provided with means for removing water.

The cofferdam will thus, in use, be maintained in dry condition, and the bolts may be greased so they are not affected by rust, but are easily disengaged, when needed.

Figure 7:
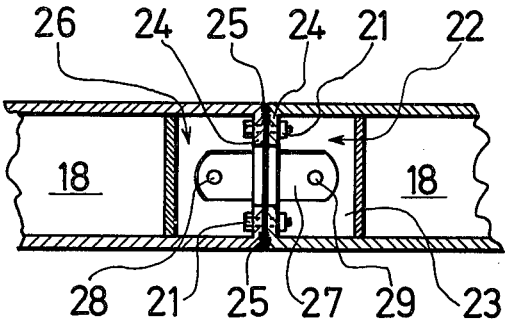
FIG. 7 shows a section along line VII—VII in FIG. 6 at two interconnected pontoons.

Concerning FIGS. 6 and 7 it should be noted, that the proportions between the breadth of the side walls, the plate thickness and the diameter of the bolts are disproportionate, being shown for the purpose of illustrating the desired functions, rather than actual dimensions. The diameter of a bolt is, for instance, only a fraction of the breadth of the side wall, and the bolts would not be visible in the scale used in the drawing. The cofferdam is so spatious that it will provide satisfactory space for the workmen.

Manholes 27 are provided in the intermediate decks 23, so the cofferdam will be fully accessible from an entrance opening in the upper part of the side wall. The manholes 27 permit the location of conduits 28 and 29 for various communication fluids, which will be described better in connection with FIG. 12.

Figure 10:
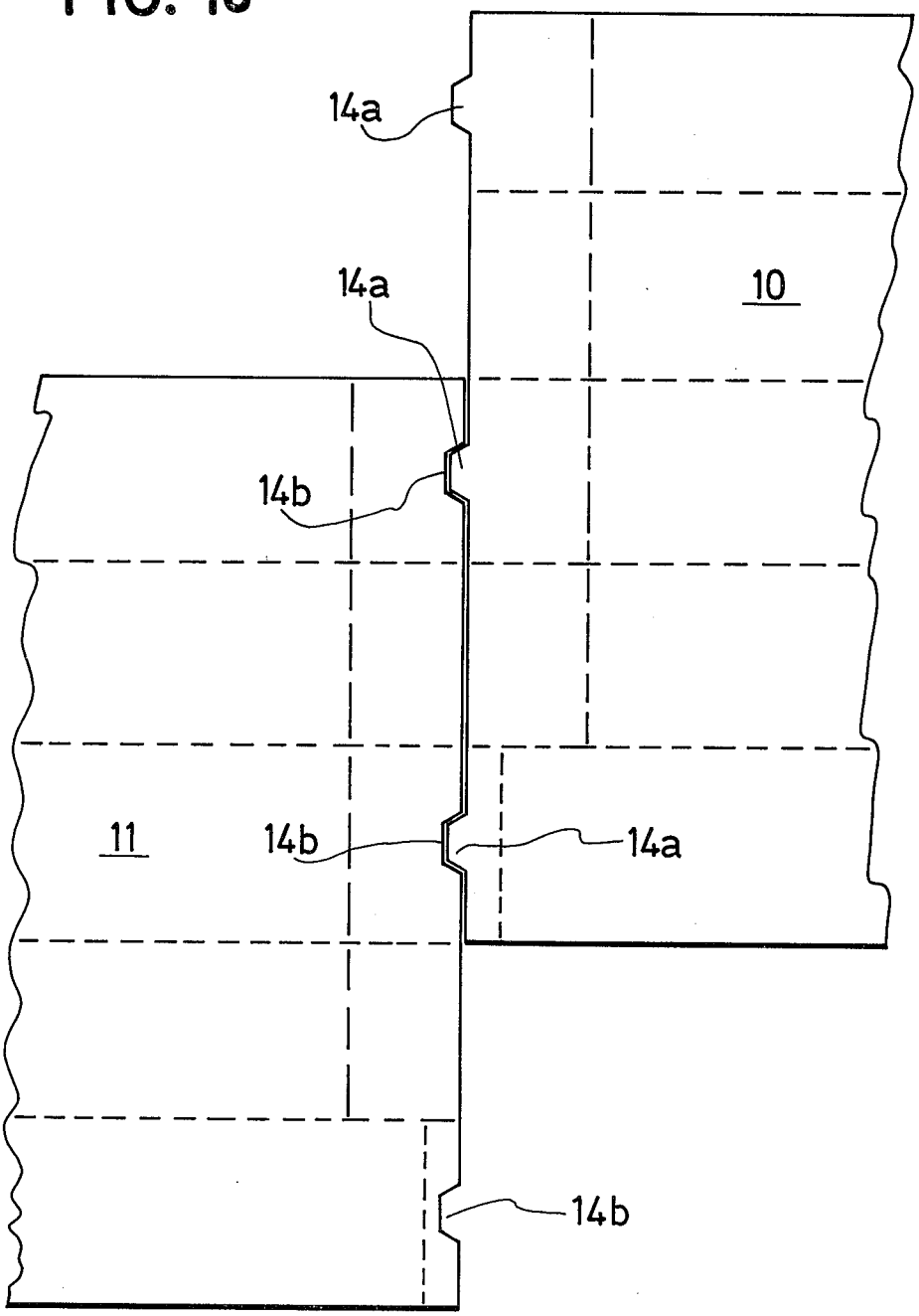
FIG. 10 shows a side view of a portion of the dock (encircled in FIG. 3), and illustrating the male and female coupling members.

FIG. 10 shows, on a larger scale, a portion of a joint between an end pontoon 11 and the middle pontoon 10 (encircled in FIG. 3). At each side wall of the middle pontoon there are three pairs of male coupling members 14*a*, and in this end pontoon there are three mating pairs of female coupling members 14*b*. These members are evenly spaced in the vertical direction, and as is evident from FIG. 10, only two pairs of members are interengaging when the middle pontoon (or an end pontoon according to FIG. 2) is lifted out of the water. During normal working conditions all male and female members 14 are engaged. As is pointed out in connection with FIGS. 1–5 there are female coupling members 14*b*, at the opposite end face of the middle pontoon.

The members 14 may have varying shape and size, but a male member is preferably designed so it, by itself, slides into the female member.

When the pontoons have been disconnected by removing of the bolts 21, and the ballast tanks of the pontoon intended to carry the other pontoon are being filled with water the male members 14*a* slide out of the female members 14*b*, and the pontoons become separated.

This movement should not be permitted to become too big, so guiding means are preferably provided between juxtaposed end faces of the pontoon. The guiding means may include rigid link arms 30, FIGS. 8 and 11, or chains 31 or other pliable members, as indicated at 31 in FIG. 9.

Figure 11:
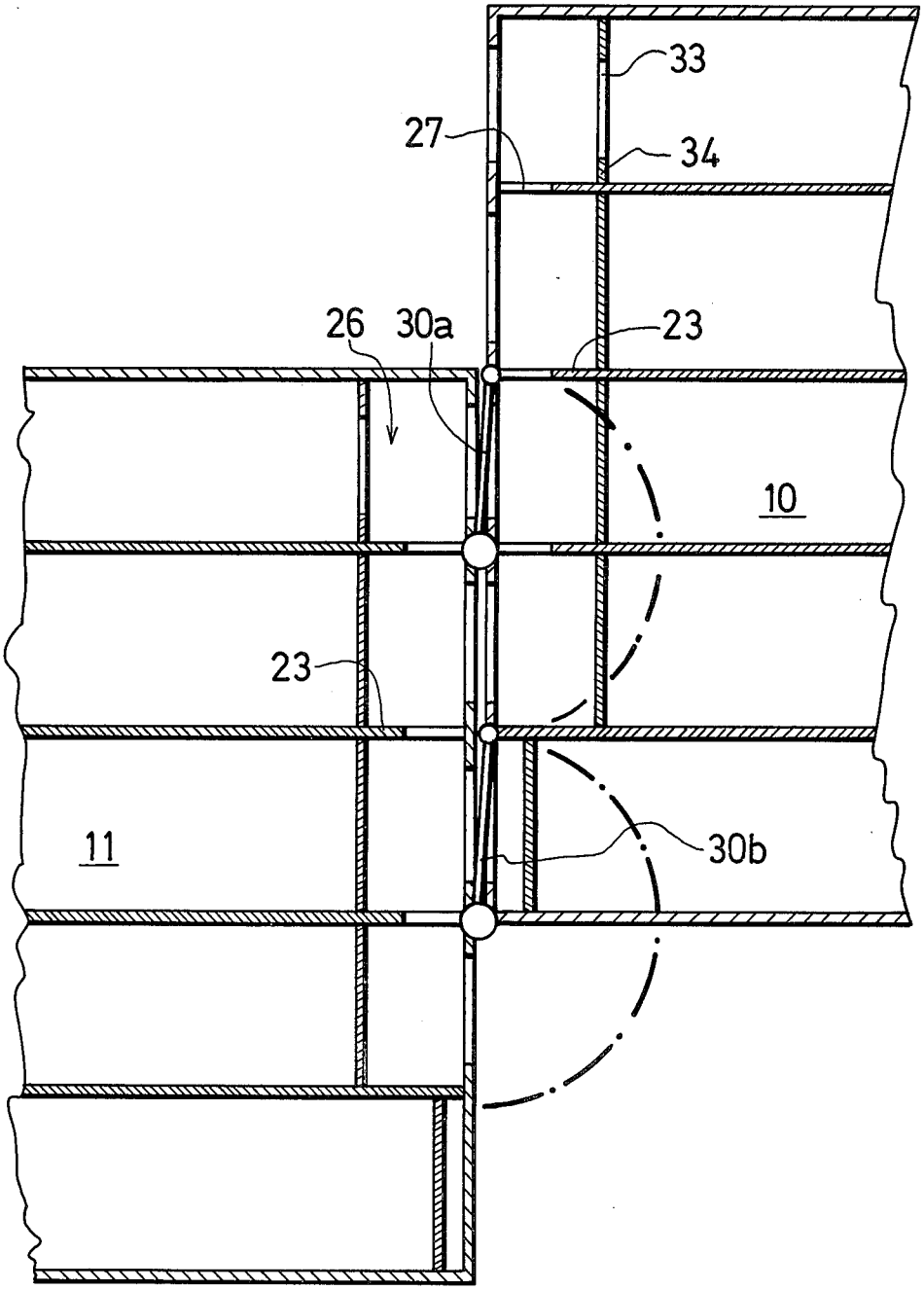
FIG. 11 shows a view corresponding to that of FIG. 10, but partly cut-up and illustrating one type of guiding members.

FIG. 11 schematically illustrates two superposed link arms 30*a, b*, which during a later part of the sinking movement of the end pontoon 11 forcibly pull the end pontoon towards the middle pontoon, so the male and female members 14 will be brought into proper engagement.

Figure 8:
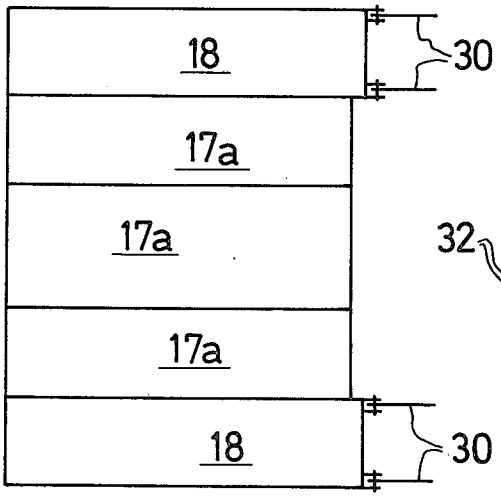
FIGS. 8 and 9 show ballast tank arrangements at the end pontoons.
Figure 9:
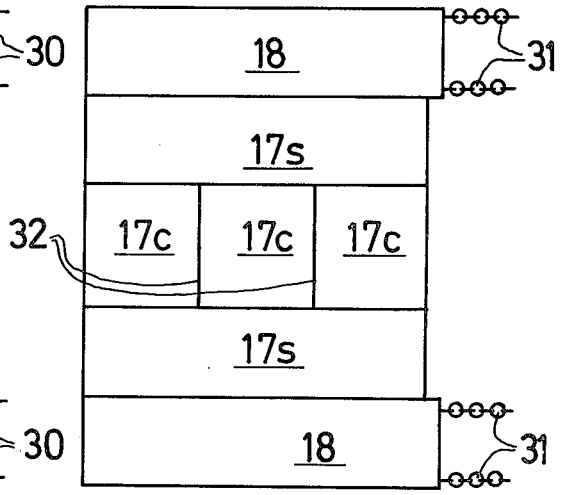

The ballast tanks 17 in the bottom portion of an end pontoon are arranged to permit a trimming of the pontoon transversely to bring it into a suitable position for engagement. Tanks 17*a* in the center portion, as well as tanks 18 below the side walls may communicate in the longitudinal direction (FIG. 8).

When the guiding means comprises chains 31, or the like, it may be necessary to trim the end pontoon longitudinally as well as transversely. Ballast tanks 17*s* below the side walls may communicate longitudinally, while side tanks 17*c* within the center pontoon are separated by transverse bulkheads 32.

Figure 12:
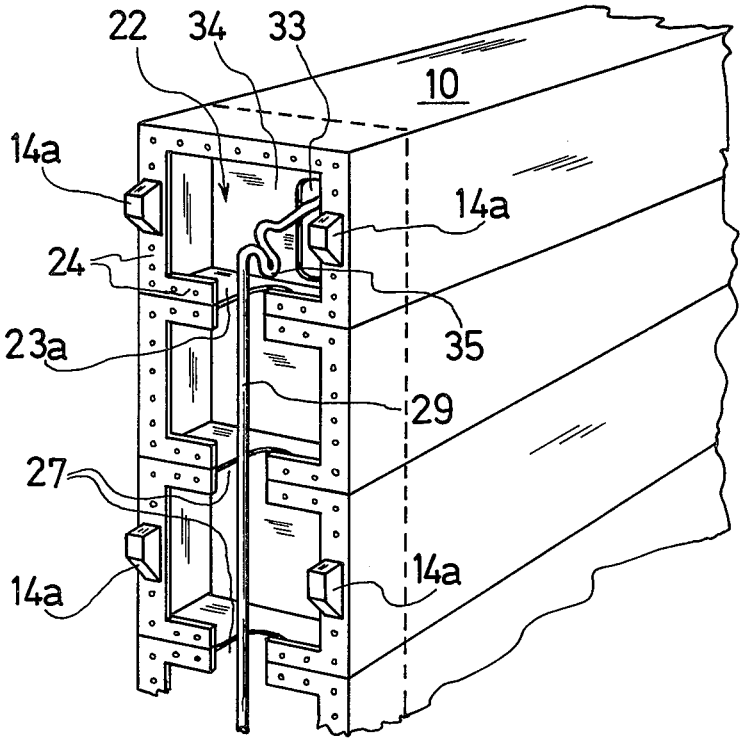
FIG. 12 shows a perspective view of an end portion of a pontoon.

FIG. 12 schematically shows a portion of one end of a pontoon with the space 22 forming part of a cofferdam. The portion of this space above the uppermost deck 23*a* will always remain above water level, and is used for internal communication by way of openings 33 in transverse bulkheads 34.

Cables and conduitry 28 and 29 pass along the upper deck 23*a* and down through the cofferdam 26 and includes pliable portions 35 and/or have a length in reserve, so they can follow relative movements of the pontoons during disconnection and connection. There is thus no need to disconnect these cables and conduits, when a pontoon is to be docked.

The ballasting and the electrical systems, as well as various measuring and control devices will thus remain intact and may be surveyed from the control housing 13. Conduits for fresh and salt water, compressed air, steam, gas and the like will also remain operative.

The embodiment above described and shown in the drawings is to be regarded as an example only, the details of which may be varied in many ways within the scope of the appended claims, with due respect to requirements concerning size and expected load.

It should be noted that the side walls, which are the portions of the dock taking care of the bending forces, will form continuous beam structures when the pontoons are fitted together. This will markedly increase the strength compared with conventional designs, where the bottom structure extends all the way to the outer shell of the side walls, and the latter, so to say, rest upon the bottom portion.

What is claimed is:

1. A floating dock of the type comprising a bottom and two parallel side walls, said dock being subdivided transversely into a middle pontoon and two end pontoons, which all are provided with individually operable ballast tanks and are removably attachable to each other, said end pontoons being dimensioned to lift said middle pontoon fully out of the water, and the latter being so dimensioned that it can lift said end pontoons fully out of the water, said middle pontoon and said end pontoons, at juxtaposed end faces of said side walls to be turned towards each other being provided with axially directed, mating male and female coupling members, integral with said side walls and located vertically so as to permit an interengagement of said juxtaposed end faces of the pontoons in two different height positions, and releasable means for receiving said pontoons in either of said different height positions, said juxtaposed end faces of said walls each including a channel formed space, said spaces, when fitted together, forming a watertight cofferdam within which said releasable means are fully accessible in a dry state.

2. The floating dock according to claim 1, further comprising guiding means interconnecting said juxtaposed end faces of adjacent pontoons and permitting a vertical displacement of said pontoons between said two different height positions.

3. The floating dock according to claim 1, in which said guiding means comprises rigid link arms, and in which said ballast tanks within said end pontoons are arranged to permit a trimming of the pontoons transversely.

4. The floating dock according to claim 1, in which said guiding means comprises chains or similar non-rigid members, and in which said ballast tanks within said end pontoons are arranged so as to permit a trimming of the end pontoons longitudinally as well as transversely.

5. The floating dock according to claim 1, in which said cofferdams within said side walls extend from the top to the bottom thereof, while the bottom portions of said pontoons lack interconnecting means.

6. The floating dock according to claim 2, in which said male and female coupling members at said end pontoons are located so as to permit an interconnection of said two end pontoons to each other.

7. A floating dock of the type comprising a bottom and two parallel side walls, said dock being subdivided transversely into a middle pontoon and two end pontoons, which all are provided with individually operable ballast tanks and are removably attachable to each other, said end pontoons being dimensioned to lift said middle pontoon fully out of the water, and the latter being so dimensioned that it can lift said end pontoons fully out of the water, said middle pontoon and said end pontoons, at juxtaposed end faces of said side walls to be turned towards each other being provided with axially directed, mating male and female coupling members, integral with said side walls and located vertically so as to permit an interengagement of said juxtaposed end faces of the pontoons in two different height positions, guiding means interconnecting said juxtaposed end faces of adjacent pontoons and permitting a vertical displacement of said pontoons between two different height positions, and releasable means at said end faces for receiving said pontoons in either of said different height positions, and further, means for communication between the said middle pontoon and the ballast tanks in said end pontoons arranged in conjunction with said end faces and including portions making the communication means unaffected by displacement of any of said pontoons between said two different height positions to permit trimming of said end pontoons when released from said middle pontoon.

* * * * *